US006832546B2

(12) United States Patent
Bredahl et al.

(10) Patent No.: US 6,832,546 B2
(45) Date of Patent: Dec. 21, 2004

(54) EMBOSSING DEVICE

(75) Inventors: Gunnar Bredahl, Worms (DE); Bernhard Reichling, Speyer (DE); Wolfram Schnikoreit, Unterabtsteinach (DE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 10/319,486

(22) Filed: Dec. 16, 2002

(65) Prior Publication Data

US 2003/0110961 A1 Jun. 19, 2003

Related U.S. Application Data

(60) Provisional application No. 60/340,250, filed on Dec. 18, 2001.

(51) Int. Cl.[7] ..... B31F 1/07

(52) U.S. Cl. ..... 101/3.1; 156/209; 101/5

(58) Field of Search ..... 101/4–6, 22, 23, 101/28, 3.1; 72/196, 197; 156/553, 555, 556, 209, 219

(56) References Cited

U.S. PATENT DOCUMENTS

| | | | | | |
|---|---|---|---|---|---|
| 4,280,978 | A | * | 7/1981 | Dannheim et al. | 264/156 |
| 4,543,142 | A | * | 9/1985 | Kuepper et al. | 156/209 |
| 4,651,552 | A | * | 3/1987 | Ahrweiler | 72/245 |
| 4,902,366 | A | * | 2/1990 | Bader | 156/296 |
| 5,269,983 | A | * | 12/1993 | Schulz | 264/400 |
| 5,339,730 | A | * | 8/1994 | Ruppel et al. | 101/32 |
| 5,689,990 | A | * | 11/1997 | Deeley | 72/196 |
| 5,714,041 | A | * | 2/1998 | Ayers et al. | 162/111 |
| 5,736,223 | A | * | 4/1998 | Laurent | 428/154 |
| 5,906,711 | A | * | 5/1999 | Barnholtz | 162/132 |
| 6,109,326 | A | * | 8/2000 | Leakey et al. | 156/553 |
| 6,306,482 | B1 | * | 10/2001 | Ruppel et al. | 428/154 |
| 6,368,539 | B1 | * | 4/2002 | Greenfield et al. | 264/284 |
| 6,395,133 | B1 | * | 5/2002 | McNeil | 162/132 |
| 6,470,945 | B1 | * | 10/2002 | Biagiotti | 156/553 |

FOREIGN PATENT DOCUMENTS

| | | | | |
|---|---|---|---|---|
| EP | 275231 A | * | 7/1988 | B29C/59/04 |
| EP | 1074381 A1 | * | 2/2001 | B31F/1/07 |
| WO | WO99/41064 | | 8/1999 | |

* cited by examiner

*Primary Examiner*—Andrew H. Hirshfeld
*Assistant Examiner*—Andrea Evans
(74) *Attorney, Agent, or Firm*—Young & Thompson

(57) ABSTRACT

An embossing device for tissue paper converting apparatus, includes a first roll and a second roll cooperating with each other to emboss a web of tissue paper in-between, first protrusions on the circumference of the first roll cooperating with the second roll to form a first nip with a first gap in-between, second protrusions on the circumference of the first or second roll cooperating with the other of the first and second roll as a counter roll to form a second nip with a second gap in-between. The embossing device further includes an adjusting means for selectively adjusting the second gap of the second nip of some or all second protrusions.

15 Claims, 7 Drawing Sheets

12
14
20
24a
24b
26
22a
22b

EMBOSSING DEVICE

FIELD OF THE INVENTION

The invention relates to an embossing device for tissue paper comprising a first and a second roll cooperating with each other to emboss a web of tissue paper in-between.

STATE OF THE ART

The embossing of sheet materials or the deforming of sheet or strip material, especially of non-woven fibre webs, is usually carried out by means of two rotatable calender rolls having an embossing nip formed in-between. The web material to be embossed is guided between these rolls. At least one of the cooperating rolls is provided with raised discrete locations forming a signature surface pattern to be embossed. These raised discrete locations will be referred to as protrusions in the following. The embossing can serve several purposes. It can be used to provide a stiffening effect, to impress an esthetic pattern or to provide a ply bonding between a multitude of individual plies in the web.

The embossing devices can comprise one flat steel roll and one embossed positive (male) roll which is generally referred to as an SSE-system (single soft embossing). In this system the paper plies are embossed on a hard roll with hard protrusions and then led through a nip between the hard embossing roll and another hard roll with a flat surface. In this nip the plies are mechanically bonded to each other. A suitable material for the hard rolls and the protrusions are steel. Other embossing devices are the UNION-embossing or the nested embossing which are especially used to provide ply bonding between different tissue plies with or without the additional use of an adhesive. Beside the technical effect of the embossing, the esthetic effect increasingly gains importance. Consequently, there is a desire to produce different products with different embossing patterns. Moreover, it has to be distinguished between brand products and so-called private or white label products. Quality features like softness, or stability can usually only be recognised during use of such a product. Therefore, the provision a brand name or trademark on the products is often the only recognisable difference between brand products and white label products.

Since different products are manufactured on the same paper converting machines, it is necessary to changeover these machines to different products with different embossing designs. There is a constant desire to reduce the changeover times. These are usually determined by the required time to exchange the embossing rolls. The disassembly and assembly of a roll, the correct adjustment of the nip between the parallel rolls and the exact positioning of the embossing roll relative to the counter roll requires about one working day. This leads to a certain inflexibility of the production because a good production planning normally tries to avoid any unnecessary exchange of the rolls.

The positioning of two complete embossing stations with different embossing rolls which are positioned one after the other in the running direction of web to be processed might reduce the downtime during the exchange or the maintenance of an embossing roll. However, this is a very expensive and, moreover, space consuming solution. Due to the space restrictions it is in most cases not possible to integrate a further complete embossing station into an existing production line. DE 199 36 278 suggest to provide an embossing station with at least two embossing rolls positioned around a counter roll. Each embossing roll can be moved between an operating position and a resting position. In the resting position, there is a sufficient nip between the embossing roll and the counter roll so that, while the web is passing through, this nip is not activated.

EP 0 275 231 B1 describes an embossing station for paper products which can achieve more than one pattern on a web without exchange of embossing rolls. Based on the object to shorten the time for a change of the embossing pattern, it is suggested to use a foot-to-foot embossing between rolls which are separately driven at synchronized speed. By changing the degree of overlap between mutually facing pairs of protrusions which determines the embossed areas, the embossed areas and, therefore, the embossing pattern can be adjusted between a maximum overlap and a minimum overlap. The degree of overlap between the mutually facing pairs of protrusions can be adjusted by axial or radial displacement of at least one of the two rolls.

SUMMARY OF THE INVENTION

It is the object of the invention to provide an embossing device which minimizes the changeover time and, at the same time, provides a high flexibility in changing the embossing patterns.

The inventive embossing device has first embossing protrusions on the circumference of a first roll cooperating with a second roll to form a first nip with a first gap in-between. There are second embossing protrusions on the circumference or the first or second roll cooperating with the other first or second roll as a counter roll to form a second nip with a second gap in-between. Further, the embossing device comprises an adjusting means for selectively adjusting the second gap. This provides a high variability of the embossing device. As an example, the first protrusions could form an esthetic embossing pattern, whereas the second protrusions might add a certain brand name or trademark to the embossing pattern. The provision of the adjusting means makes it possible to selectively adjust the second gap, which is the gap between the brand name or trademark and the counter roll. Therefore, it is possible to fade out the provision of the trademark or brand name in the overall embossing pattern of the product. Another possibility is to selectively adjust the second gaps so that the impressing depths of the second protrusions leads only to the embossing of the brand name on one side of the product. This avoids the occurrence of a mirror-inverse impression of the embossing pattern on the backside of the product. The above given two examples only cover a part of the different possibilities of product variations which can be easily performed with the inventive device. Besides these examples all relating to the selective adjusting of the second gap independently of the first gap, there are also possibilities for completely switching between two different embossing patterns. In that case the adjusting means for selectively adjusting the second gap also influences the first gap.

According to a preferred embodiment of the invention, the first roll is made of steel and the second roll is made of rubber. According to an alternative preferred embodiment, the first and second roll are made of steel. In that case using an SSE-system, it is preferred to provide one flat steel roll and one embossed positive steel roll cooperating with each other. The inventive embossing device can also be of a union-type.

Preferably, the first and the second roll are synchronised relative to each other. This is important in all those configurations, where one of the rolls is not a flat roll.

Then the embossing device is only operable if the two cooperating rolls are in register so that the relative position of the protrusions and/or depressions on both rolls are always in a predetermined and controlled position relative to each other.

The synchronisation of the two rolls can be advantageously achieved by means of a gear box or a synchronous belt drive between both rolls.

According to a preferred embodiment of the invention the adjusting means comprises a means for displacing the first and second roll relative to each other in an axial direction. Such an axial displacement changes the relative position of the second protrusions and corresponding protrusions or depressions on the counter roll relative to each other so that the gap of the nip in the region of the second protrusions can be selectively adjusted.

The same can be achieved by displacing the first and second roll in a circumferential direction relative to each other. A displacement in a circumferential direction can be performed by turning one of the rolls by a certain amount whereas the other roll is held still. Another theoretical possibility is to run both rolls synchronously, i.e. with the same circumferential speed and, during a certain changeover time, to rotate one of the rolls with a higher speed to achieve a circumferential shift between both rolls. However, this theoretical possibility is difficult to achieve in practice because the web passing between the two rolls undergoes a shearing load due to the differences in the circumferential speed between both rolls during the changeover operation. This could lead to a tearing of the product web to be processed. Moreover, it should be kept in mind that according to this embodiment the circumference of the rolls is important because it should have an integer number of design lengths. Each design pattern has a specific length in the circumferential direction of the embossing cylinders. The easiest variant is that both rolls have to have the same circumference and an equal number of design lengths. If the rolls have different circumferences, they have a circumference corresponding to an integer number of design lengths along their circumference. In other words, the ratio of the circumference and the length of the design should be an integer for both embossing rolls. Only then the embossing pattern will be constantly repeated on the web of tissue paper.

According to a preferred embodiment of the invention, the second protrusions are placed on additionally provided embossing elements, the position of which is adjustable in a radial direction of the roll so that they are movable from one effective, embossing position into a retracted, non-effective position. This preferred embodiment has the advantage that the movement of the additionally provided embossing elements acting as signature elements can be performed during the normal operation of the embossing device. The changeover time is reduced to a minimum, namely the time required to move these embossing elements from the embossing position into the retracted position and vice versa. Moreover, this embodiment opens up the option to selectively move only some of the second protrusions at one time.

If such additionally provided embossing elements are used, it is preferred to provide them with rounded edges. This avoids the inadvertent embossing of sharp edges of these embossing elements into the web of tissue paper.

According to preferred embodiment, the position of the additionally provided embossing elements is adjustable by means of an oil pressure system. The use of a hydraulic system has the advantage that the embossing pressure can be easily adjusted. Other possibilities do adjust the position of the additionally provided embossing elements comprises spring loaded or electromagnetically operated embossing elements of the lying of slims (thin plates) under the embossing elements. The embossing elements can also be adjusted by a wedging action of underlying slims cooperating with a tapered surface of the embossing elements. A preferred embodiment for providing an oil pressure system comprises the attachment of the embossing elements to pistons which are movable within cylinders in fluid communication with lines for pressurised oil. Depending on the oil pressure in the cylinders, the pistons move the attached embossing elements into the embossing position or the retracted position.

According to a preferred embodiment, the oil pressure system further comprises biasing elements to bias the embossing elements into the retracted, non-effective position. These biasing elements can be realised in form of spring elements which have to be selected to hold the embossing elements in the retracted, non-effective position against the centrifugal force during rotation.

According to a further preferred embodiment of the invention, there is additionally provided a means to selectively hold some selected embossing elements in the effective position whereas the other embossing elements are in the non-effective position. This embodiment enables the use of different additional design elements or brands which are selectively added to a basic pattern.

Common to all above cited preferred embodiments is the possibility to provide at least one of the rolls with a certain bombage in order to compensate the sagging of the rolls due to their weight.

BRIEF DESCRIPTION OF THE DRAWINGS

In the following, some exemplified embodiments of the invention will be described with reference to the accompanying drawings. In the drawings.

DETAILED DESCRIPTION OF PREFERRED EMBODIMENTS

Figures 1, 2, 3:
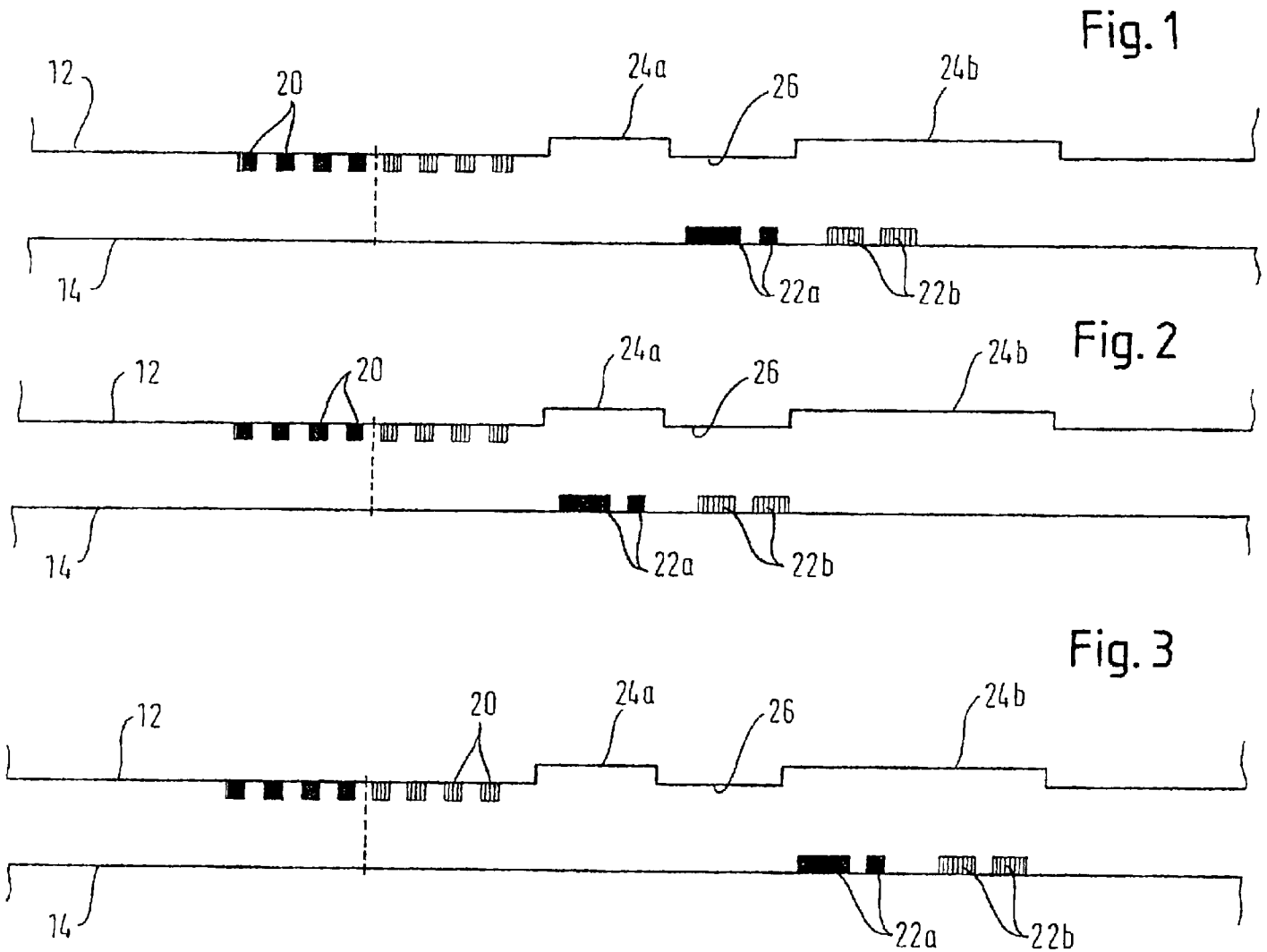
FIGS. 1 to 3 depict three examples of an embodiment of the invention which show diagrammatically the circumference of the cylindrical first roll and second roll as developed and in different positions relative to each other.

In the following, several different embodiments of the invention will be described. Through out the different views, the same reference numerals are used for the same or corresponding elements.

Figure 12:
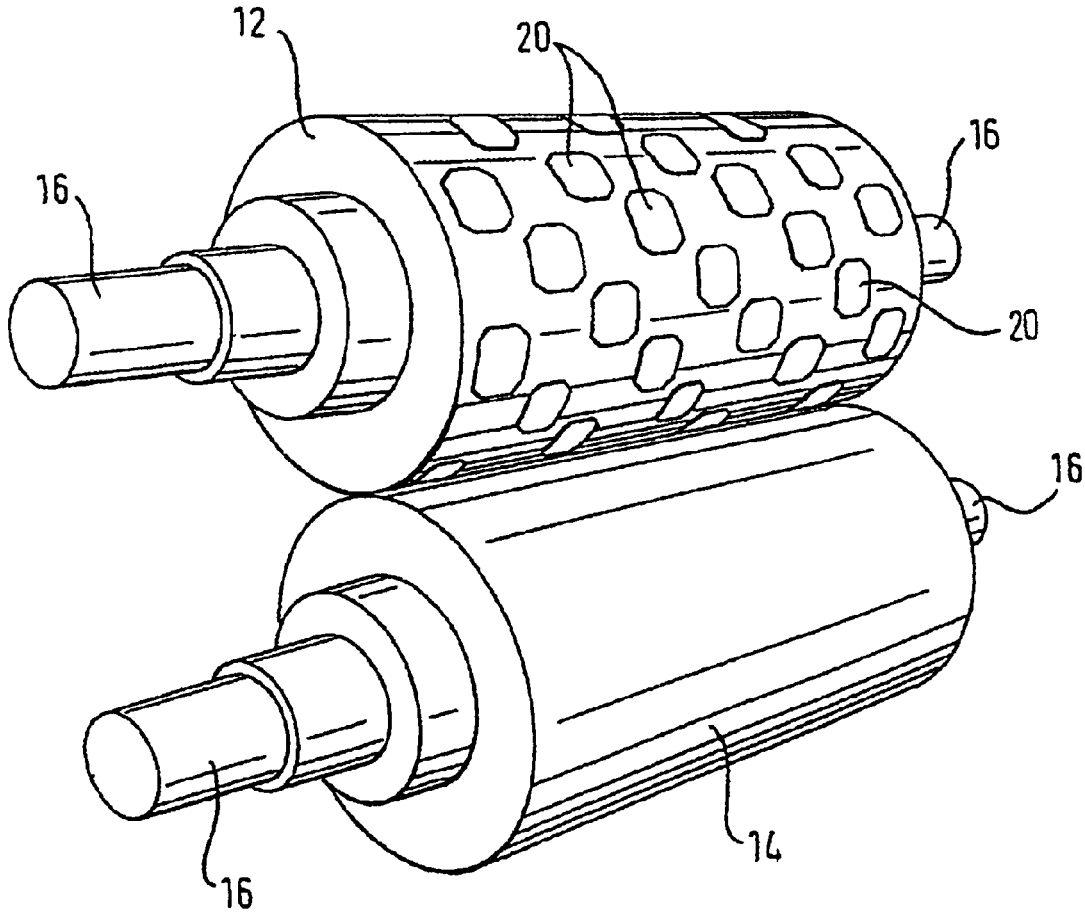
Fig. 12 PRIOR ART
FIG. 12 shows two cooperating rolls forming the main parts of an embossing device within the state of the art.

Starting with FIG. 12, the main constituting elements of a prior art embossing device are shown. There is a first roll 12 and a second roll 14 which are mounted to a machine frame (not shown) of the embossing device. The rolls 12, 14 can be rotated around their longitudinal axes which are preferably parallel to each other. Both rolls are provided with pivots 16, which hold pivot bearings 18 (shown in FIG. 9). On the first roll 12 there are first embossing protrusions 20 distributed on the outer circumferential surface thereof. The roll 14 acts as the counter roll or anvil roll and is in contact with the embossing protrusions 20 on the first roll 12. A web of tissue paper which runs through the embossing nip between the rolls 12 and 14 receives an embossing corresponding to the shape of the first protrusions 20 of the first roll 12. In the prior art example shown in FIG. 12, the second roll 14 has a flat surface with no protrusions or depressions on the circumferential surface thereof.

In FIGS. 1 to 3, a first embodiment of the invention is described. The inventive embossing station is applicable to different embossing systems. It is possible to provide a single soft embossing system with one flat steel roll and one embossed steel roll or it is possible to provide a steel-rubber pair with the steel engraved embossing roll and a counter roll made of rubber or to use a union embossing system. Part of the circumference of a first roll 12 and a cooperating second roll 14 are shown as developed. The part of the development shown in FIGS. 1 to 3 corresponds to one design pitch on the circumference of the rolls. On the first roll 12, there are first protrusions 20 which are raised from the surface towards the surface of the second roll 14. Moreover, there are depressions 24*a* and 24*b*, wherein 24*a* has a considerably smaller size than the depression 24*b*.

On the second roll 14 there are second protrusions 22 which, in the example shown in FIGS. 1 to 3, are subdivided in two groups 22*a* and 22*b*. Without limiting this embodiment to this example, the second protrusions 22*a* and 22*b* could be different brand names. It is apparent that in the embodiment shown in FIGS. 1 to 3, the first protrusions are positioned on the first roll 12 whereas the second protrusions are positioned on the second roll 14 with the first roll acting as a counter roll. However, according to a modification of this embodiment, the second protrusions could also be on the circumferential surface of the first roll 12 with the depressions 24*a*, 24*b* provided in the second roll 14.

In the following, the different positions of the rolls 12 and 14 will be explained with reference to FIGS. 1 to 3. For sake of simplicity, the first group of second protrusions 22*a* will be referred to as a first emblem 22*a*, whereas the second group of second protrusions 22*b* is considered to be a second emblem 22*b*. In the arrangement according to FIG. 1, the first emblem 22*a* is in registration with the contact surface 26 between the depressions 24*a* and 24*b*. Same applies to the first protrusions 20, which in FIGS. 1, 2 and 3 are always facing a flat contact surface on the second roll 14. In the embodiment according to FIG. 1, however, the second emblem 22*b* faces the depression 24*b*. In that region, the gap of the nip between the second emblem 24*b* and the corresponding counter surface on the counter roll 14 is great enough so that the web of tissue paper running between the rolls 12 and 14 is not sufficiently backed up in the region of the second emblem to effect an embossing. The embossed product leaving the embossing device schematically shown in FIG. 1 will have a first embossing pattern corresponding to the first protrusions 20 and an embossing pattern corresponding to the first emblem 22*a*.

FIG. 2 distinguishes from the configuration according to FIG. 1 in that the two rolls 12, 14 are shifted relative to each other in a circumferential direction. This has the effect that the first emblem 22*a* is now in a position to oppose the small size depression 24*a* to become ineffective in the embossing process. The second emblem 22*b*, however, now opposes the contact surface 26 to be effective. The product leaving the embossing device with rolls 12, 14 in registration according to FIG. 2 will receive an embossing corresponding to the first protrusions 20 and the second emblem 22*b*.

A further possible configuration is shown in FIG. 3 in which the rolls 12 and 14 are arranged so that both the first emblem 22*a* and the second emblem 22*b* face the large size depression 24*b* to be in an ineffective position. The embossed product according to this configuration would have only an embossing pattern effected by the first protrusions 20.

The relative movement of the two rolls 12, 14 to effect the different embossing patterns according to FIGS. 1, 2 and 3 can be performed by preferably stopping the machine, moving apart the two rolls 12, 14 to increase the nip gap in-between and by selectively turning the two rolls relative to each other into the new position. Then the two rolls are moved again in their operating position with a desired gap of the embossing nip between the contact surfaces and the protrusions and the machine is restarted again. To ensure that the first and the second roll are in the correct registration with each other, their rotational movement has to be synchronised by means of a suitable gear box or a synchronous belt drive.

As indicated above, FIGS. 1 to 3 show a design pitch of a developed circumferential surface of the first and second roll, respectively. The embossing pattern and especially the gap of the nip of some or all second protrusions is changed by displacing the first and second roll relative to each other in a circumferential direction. However, a similar diagrammatical view as that according to FIGS. 1, 2 and 3 could also be used to illustrate the second possible alternative for selectively adjusting the gap of the nip of some or all second protrusions. This can be also performed by displacing the first and second rolls relative to each other in an axial direction. The essential point is always that there has to be a relative movement between the two rolls so that some or all second protrusions are brought into a position opposing a depression in the counter roll so that the second protrusions become ineffective in the embossing process.

Figure 4:
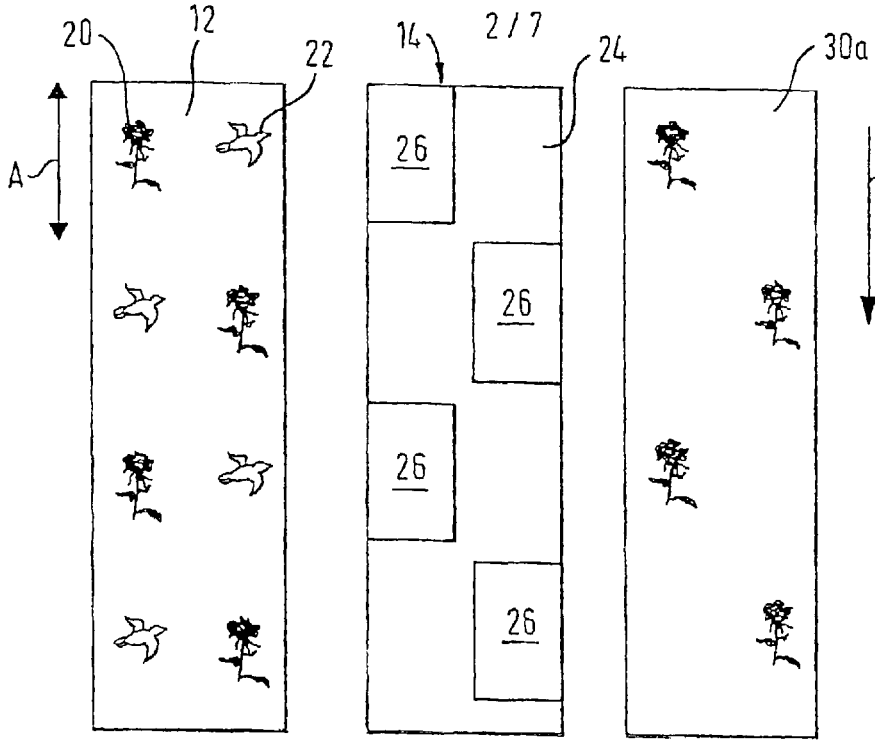
FIGS. 4 and 5 show diagrammatically another example of the two rolls as developed and the embossed product resulting therefrom.
Figure 5:
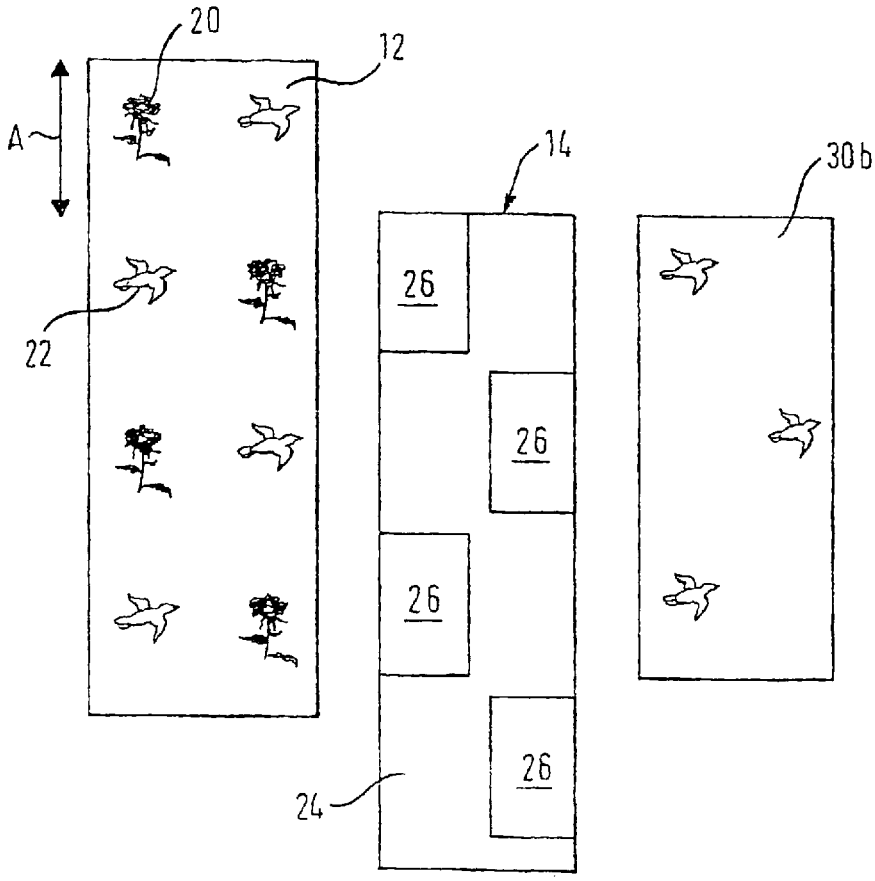

FIGS. 4 and 5 show another embodiment of the invention also including the embossed web 30*a*, 30*b*. There are shown two different relative positions of the outer circumferential surface of the first roll 12 and second roll 14. In FIGS. 4 and 5, the circumferential surfaces are also shown as developed. It can be seen that the first roll has first protrusions in the shape of a flower and second protrusions in the shape of a bird. These protrusions are arranged repeatedly on the circumferential surface of the first roll 20 with a design pitch A. This means that during one single revolution of the first roll 20, the first and second protrusions can be four times embossed into the web of tissue paper.

The corresponding second roll acting as a counter roll has raised regions 26. Correspondingly, the other parts of the circumferential surface of the second roll 14 correspond to the depressions 24 according to the embodiments of FIGS. 1 to 3. If the two rolls 12, 14 according to FIG. 4 are in an operating position and a web of tissue paper to be embossed passes the machine direction B through the nip between the first and second rolls, only the first protrusions (flowers)

opposing the raised contact surfaces 26 are embossed on the web 30*a* of tissue paper.

In the diagrammatically shown example in FIG. 5, the first roll 12 and the second roll 14 are circumferentially moved by a circumferential distance corresponding to a design pitch A. This has the effect that the second protrusions 22 are opposing the raised contact surfaces 26 so that the embossed tissue web 30*b* shows only second embossed protrusions (birds).

In the embodiments of the embossing device according to FIGS. 4 and 5, it is also possible to selectively adjust the gap of the nip of the second protrusions. However, contrary to the embodiment according to FIGS. 1 to 3, this also influences the first protrusions. In the embodiments according to FIGS. 1 to 3, the first protrusions remain always in an effective position, whereas in the embodiment according to FIGS. 4 and 5, the first and second protrusions are brought in an alternating manner into their effective position.

In the embodiment according to FIGS. 4 and 5, the first roll 12 is preferably an engraved steel roll, whereas the second roll 14 is made of rubber. Normally, the lifetime of the rubber surfaces is limited due to the repeated impressions of the protrusions of a certain design element into the rubber surface. Since the first protrusions and second protrusions press into different positions on the contact surface 26 of the rubber anvil roll 14, the lifetime of the rubber roll is increased when the embossing designs are exchanged in an alternating manner.

The embodiments according to FIGS. 1 to 5 have in common that a change of the embossing pattern is carried out by changing the position of the first and second roll relative to each other. This is only technically feasible if the machine is stopped because any differences in the circumferential speed of the two rolls or a shifting in the axial direction during the machine run implies the danger that the tissue web to be processed tears or gets otherwise damaged under the shear forces resulting from this relative movement of the two rolls.

Figure 6:
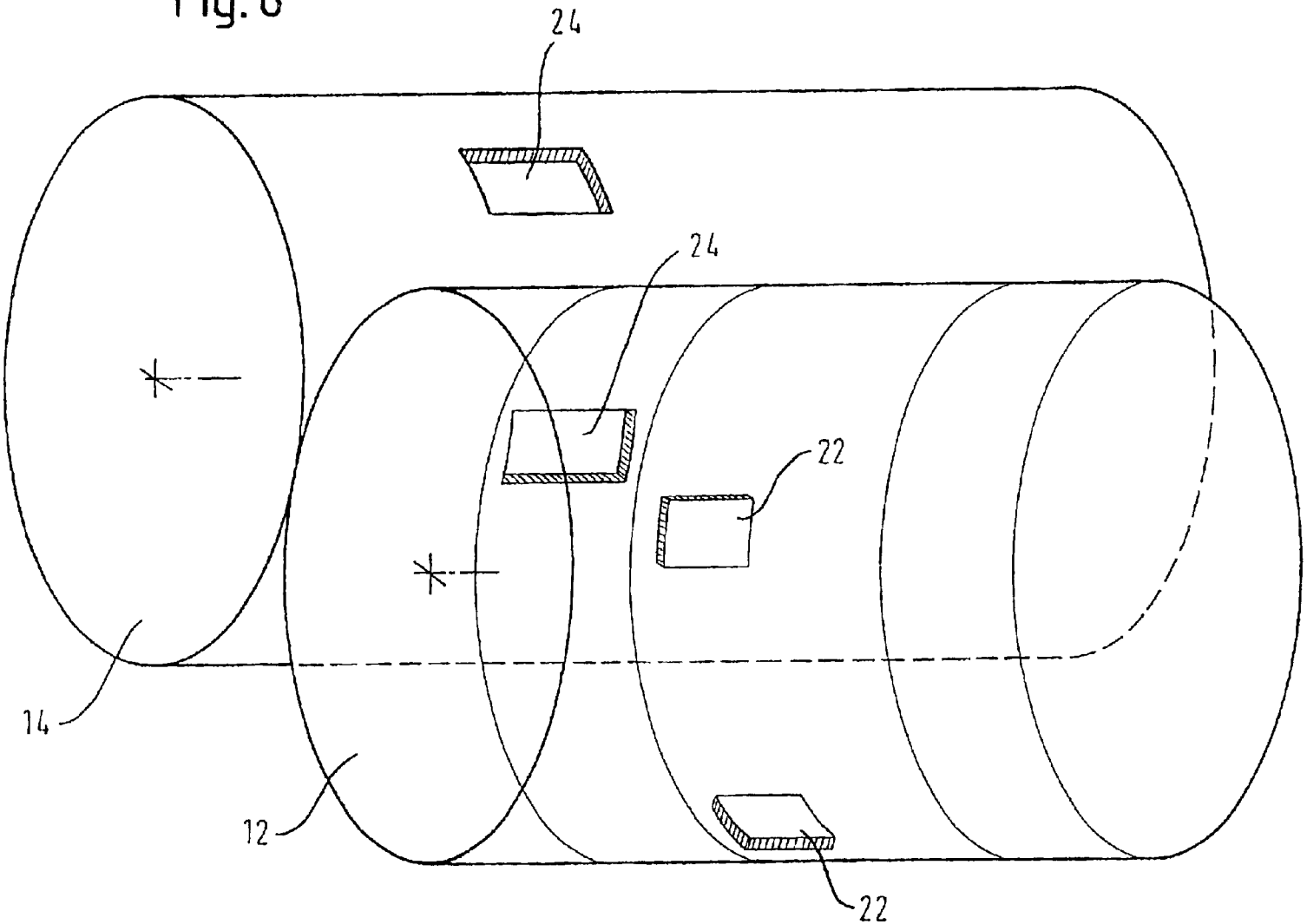
FIG. 6 shows diagrammatically an embodiment with second embossing protrusions mounted on separately provided embossing elements.

The embodiment according to FIG. 6 is similar to that according to FIG. 1. One difference resides in that the second protrusions 22 are fixed as separate signature plates or shims to the first roll (first protrusions on the first roll omitted for reasons of simplicity) with correspondingly formed depressions 24 which are provided on the second roll 14 and can be aligned with the second protrusions 22 so that no embossing occurs in the region of the second protrusions. The main principle of an axial or circumferential relative movement of the two rolls corresponds to that already described in the context of FIGS. 1 to 3. It is apparent to those skilled in the art that the depressions 24 have to be provided with a larger size than the protrusions 22 so that the web of tissue paper to be processed between the rolls 12 and 14 is not damaged. Moreover, the edges of the embossing shims 22 should not become visible in the embossed product. Therefore, it is preferred to provide rounded edges of the additionally provided embossing elements with the second protrusions.

In all above described embodiments, the movement of the two rolls can be achieved by means of a gear system. The relative movement of the rolls is performed by disassembly of the gears and their readjustment based on the desired register of the two rolls relative to each other. In order to reduce the changeover time, a servo motor can be used. In the example according to FIG. 6, the flat roll 14 can be easily individually turned in its operating positions because the depressions 24 do not impede their movement. If the rolls are adjusted by an axial movement, care has to be taken that the length of the rolls is sufficient to compensate for the relative changes of the position of the rolls. Same applies to the drive of the rolls. For a device with rolls, which can be axially shifted, broad gears can be provided. Another possibilities is the provision of a toothed hollow shaft which ensures the transmission of torque independently of the axial position of a pinion gear within the hollow shaft.

Figure 7:
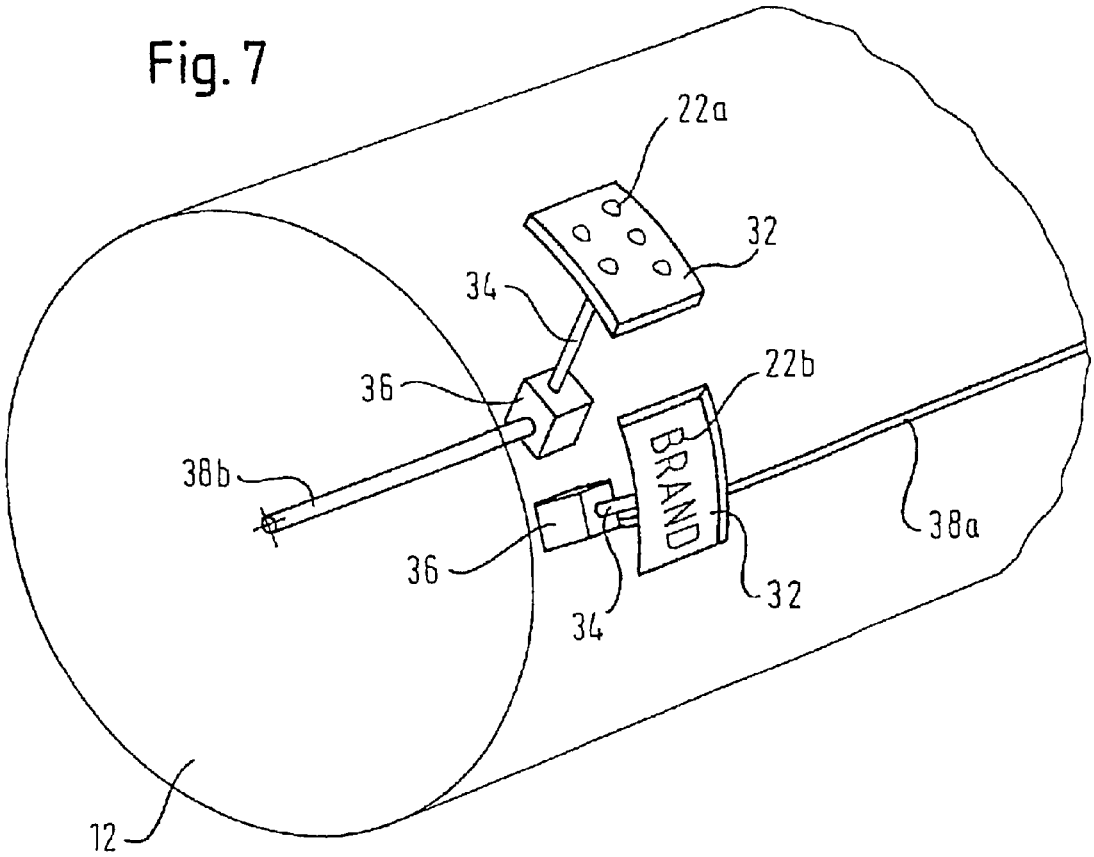
FIG. 7 shows an embossing roll similar to that shown in FIG. 6 with a hydraulic actuation system for separately provided embossing elements with individual hydraulic units.
Figure 8:
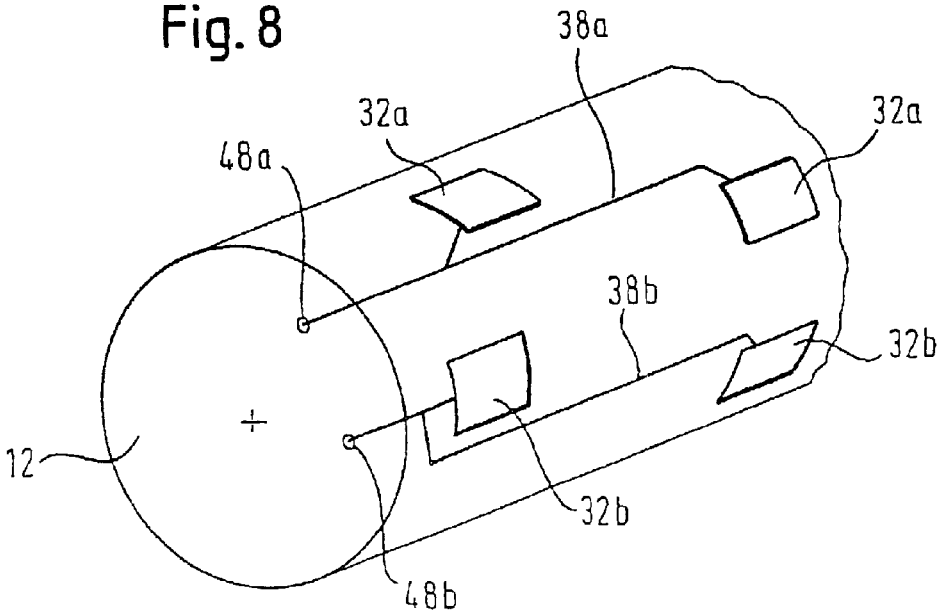
FIG. 8 shows an embodiment similar to that according to FIG. 7 with a plurality of embossing elements in communication with individual hydraulic pressure lines.

FIGS. 7 to 11 show further embodiments with oil pressure controlled embossing elements. FIG. 7 serves to explain the principles of this solution. In the examples according to FIGS. 7 to 11, it is always assumed that the additional embossing elements are provided on the first roll 12. Moreover, the provision of first protrusions 20 is omitted in these drawings. Those skilled in the art should realise that the embodiments shown in FIGS. 7 to 11 are also applicable for second protrusions provided on the second roll 14 and independent of the provision of first protrusions on the same or the counter roll.

In the embodiment according to FIG. 7, the second protrusions 22*a*, 22*b* are provided on curved, outwardly facing surfaces of embossing elements 32. The embossing elements 32 are attached to pistons 34 which are operated from one common or individual hydraulic units 36. In the example according to FIG. 7, there are two pressure lines 38*a*, 38*b* for supplying high pressure oil to the hydraulic units 36. The hydraulic units 36 move the pistons 34 and attached embossing elements in radial direction so that they can be brought into an effective, embossing position and a retracted, non-effective position. The supply of oil can be best achieved through the pivot or pivot bearings to reduce technical problems in sealing the oil supply lines.

Figure 10:
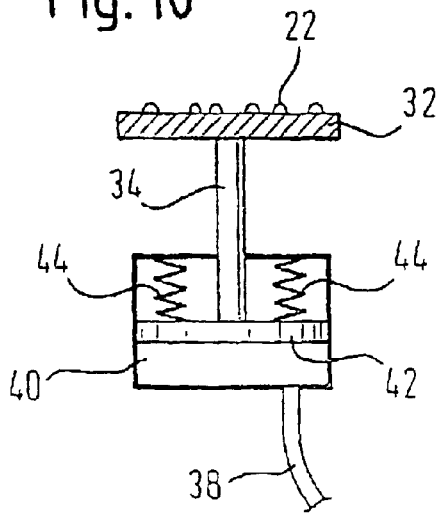
FIG. 10 shows the position of a biasing element acting on the embossing element.

FIG. 10 schematically shows an embodiment according to which the piston 34 is operated by means of the oil pressure in a cylinder chamber 40 acting on a plate 42 which sealingly engages the walls of the cylinder and is fixed to the piston 34. Thus, pressurized oil supplied through pressure line 38 presses the plate 42 radially outwards so that the embossing element is moved into an effective embossing position. To retract the embossing element again, there are springs 44 provided in the cylinder chamber 40 which act on the plate 42 to bias the embossing element into its non-effective retracted position. The springs 44 have to apply a sufficient force also to compensate the centrifugal forces acting on the embossing elements when the roll is rotating fast.

Figure 9:
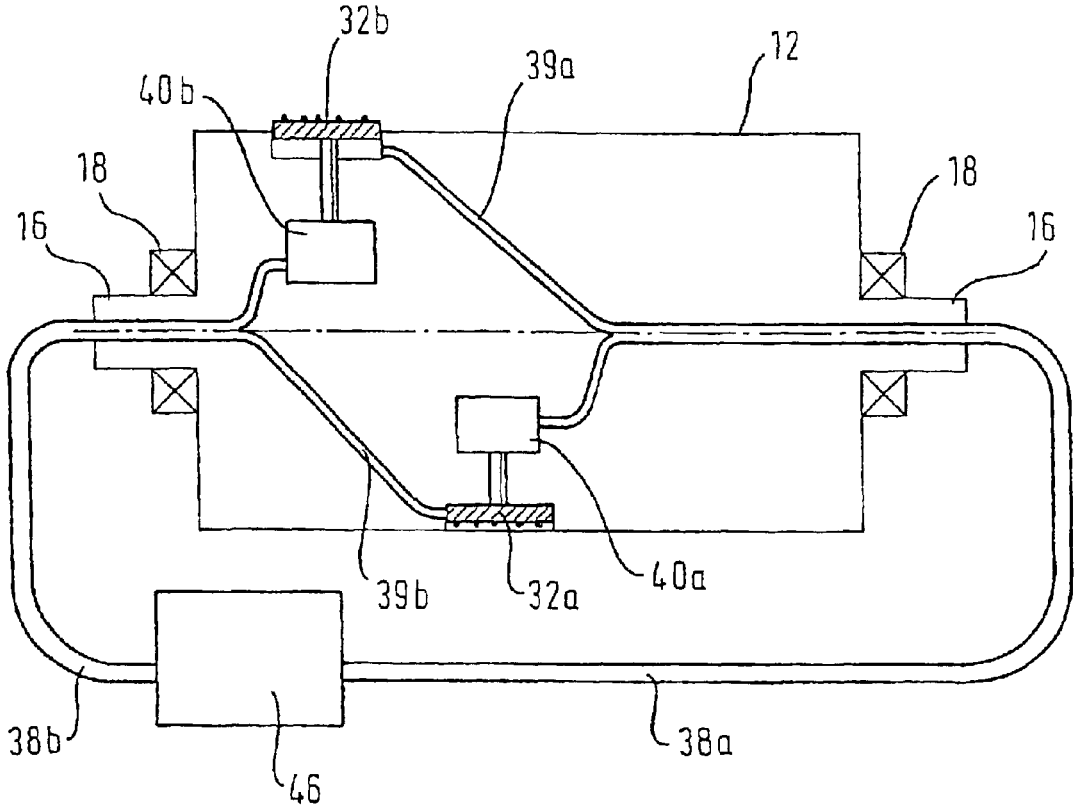
FIG. 9 shows a further embodiment of the hydraulic system with a common hydraulic unit and including the possibility to actuate only some of the additionally provided embossing elements.
Figure 11:
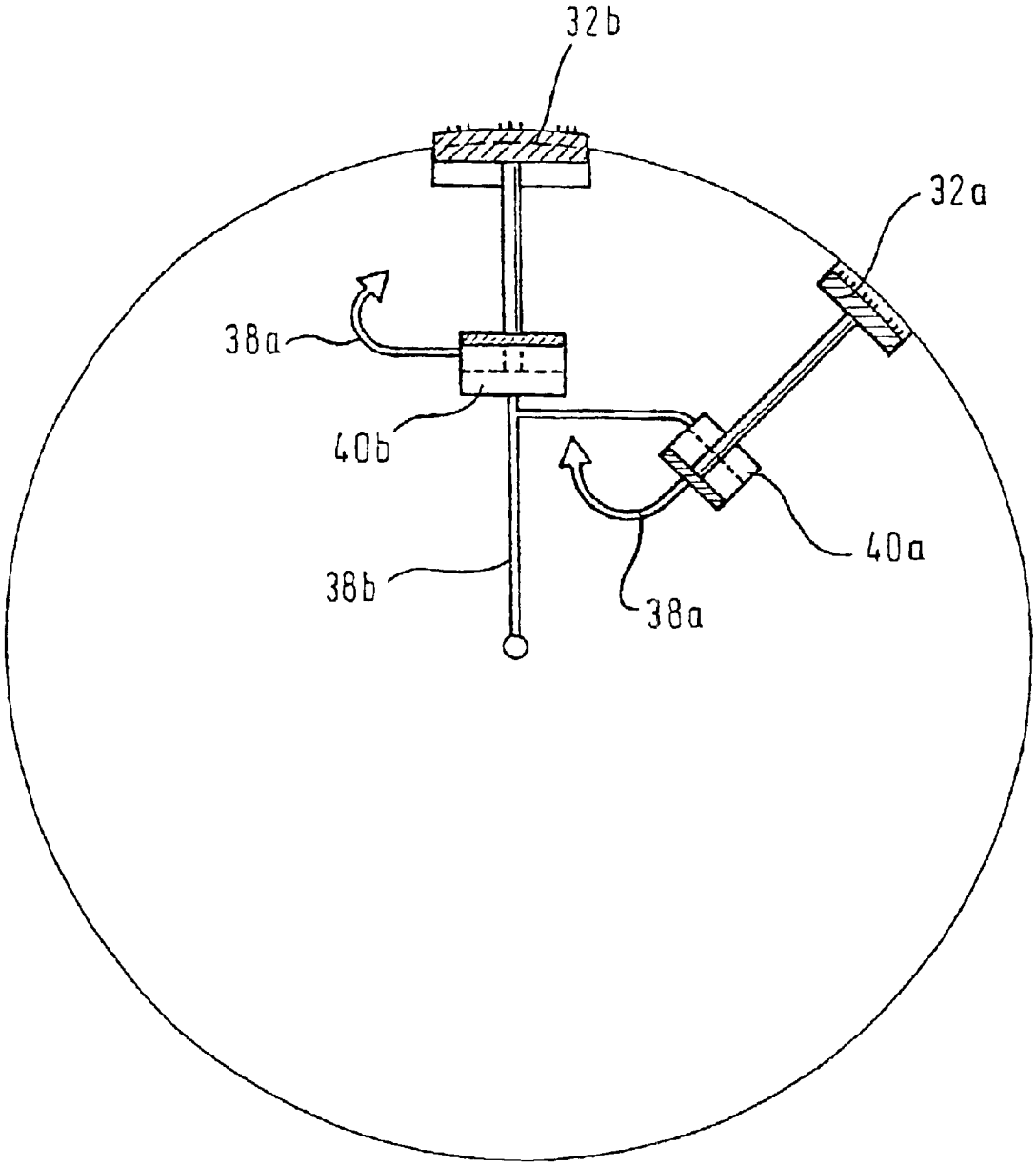
FIG. 11 is a sectional view in a radial direction of a hydraulic system similar to that shown in FIG. 9.

A further alternative for effecting the movement of the embossing elements in both directions is to use both sides of the roll to provide a hydraulic circuit which acts in an alternating manner on first and second emblems. Such an embodiment is shown in FIGS. 9 and 11. According to the embodiment shown in FIG. 9, there is an oil pressure control unit 46 with two pressure lines 38*a* and 38*b*. Each pressure line acts on one cylinder chamber 40*a*, 49*b*, whereas a branched off fluid pressure line 49*a*, 49*b* leads to the depression accommodating the embossing elements corresponding to the cylinder chamber 40 supplied by the other of the two fluid pressure lines. This system makes it possible to activate the embossing elements 32*a* and 32*b* in an alternating way. From FIG. 11, which is a cross sectional view of a system similar to that shown in FIG. 9, it follows that the embossing element 32*a* is in the retracted state, whereas the embossing element 32*b* is in its effective position. Moreover, in the cylinders 40*a*, 40*b* the other operational positions corresponding to the embossing element 32*b* being in the retracted position and the embossing element 32*a* being in the effective position are shown by dashed lines. The oil pressure lines 38*b* and 38*a* are schematically shown. Depending on which of the two oil pressure lines 38*a*, 38*b* is supplied with high pressure fluid, one of the embossing elements is brought and held in the effective position, whereas the other one is in the non-effective position.

Under normal operation conditions, the changing of the embossing pattern does not occur very often. Therefore, the oil pressure system can be further simplified according to the embodiment of FIG. 8. Since an oil pressure can be kept relatively constant over a longer period of time—at least if there is no leaking of oil or high temperature changes—, the pressure cylinders do not have to be supplied continuously with oil. It would be sufficient to build up the necessary pressure during a short changeover time and to keep the pressure in the pressure lines 38*a* or 38*b* by means of back pressure valves 38*a* and 38*b*. According to the embodiment diagrammatically shown in FIG. 8 more than one embossing element is operated by each oil pressure line 38*a*, 38*b*. If the embossing pattern in a system according to FIG. 8 has to be changed, the back pressure valves have to be opened so that spring move the embossing elements in the retracted position. On the other hand, the supply of high pressure oil into one or both pressure circuits moves the embossing elements in their embossing position.

It goes without saying that in the above described embodiments using an oil pressure system, the rolls have to be provided as hollow drums.

As outlined above, the inventive embossing device can be used both in SSE-systems, union systems or steel-rubber systems. Moreover, the first and second protrusions can be provided on the same roll or on different rolls. Finally, the selective adjusting of the gap of the nip of some or all second protrusions can be performed with or without influencing the embossing operation of the first protrusions. The inventive device considerably reduces the changeover time and, in the embodiments with oil pressure actuated embossing elements, the changeover can be performed fully automatically without having to stop the machine.

What is claimed is:

1. Embossing device for tissue paper, comprising:

at least a first roll and a second roll cooperating with each other to emboss a web of material in-between;

first protrusions on the circumference of the first roll cooperating with the second roll to form a first nip with a first gap in-between;

second protrusions on the circumference of the first or second roll cooperating with the other of the first and second roll as a counter roll to form a second nip with a second gap in-between; and adjusting means for selectively adjusting the gap of the second nip of some or all second protrusions, wherein the adjusting means adjust the second gap independently of the first gap.

2. Embossing device according to claim 1, wherein the first roll is made of steel and the second roll is made of rubber.

3. Embossing device according to claim 1, wherein the first roll and the second roll form a union embossing device.

4. Embossing device according to claim 1, wherein the first roll and the second roll are made of steel.

5. Embossing device according to claim 1, wherein the first and second protrusions are on the circumference of the first roll.

6. Embossing device according to claim 1, wherein the adjusting means comprise means for displacing the first roll and the second roll relative to each other in an axial direction.

7. Embossing device according to claim 6, further comprising an anvil pattern on the counter roll with depressions corresponding to the relative positions of the second embossing protrusions.

8. Embossing device according to claim 1, wherein the adjusting means comprise means for displacing in a circumferential direction the first roll or the second roll relative to each other, and a ratio of the circumferences of the first roll to the second roll is an integer number.

9. Embossing device according to claim 1, wherein at least one of the rolls has a bombage.

10. Embossing device for tissue paper, comprising:

at least a first roll and a second roll cooperating with each other to emboss a web of material in-between;

first protrusions on the circumference of the first roll cooperating with the second roll to form a first nip with a first gap in-between;

second protrusions on the circumference of the first or second roll cooperating with the other of the first and second roll as a counter roll to form a second nip with a second gap in-between; and adjusting means for selectively adjusting the gap of the second nip of some or all second protrusions, wherein the second protrusions are placed on embossing elements, whose position is adjustable in the radial direction of the roll so that they are movable from an effective embossing position into a retracted non-effective position.

11. Embossing device according to claim 10, wherein the embossing elements have rounded edges.

12. Embossing device according to claim 10, wherein the position of the embossing elements is adjustable by an oil pressure system.

13. Embossing device according to claim 12, wherein the embossing elements are attached to pistons which are movable within cylinders in fluid communication with lines for pressurized oil.

14. Embossing device according to claim 10, further comprising biasing elements to bias the embossing elements into the non-effective position.

15. Embossing device according to claim 10, further comprising means to selectively hold some of the embossing elements in the effective position, whereas others of the embossing elements are in the non-effective position.

* * * * *